US006417433B1

(12) United States Patent
Milla et al.

(10) Patent No.: US 6,417,433 B1
(45) Date of Patent: Jul. 9, 2002

(54) PEDAL DEVICE FOR A BASS DRUM

(76) Inventors: Michael Milla, Maximilianstrasse 20; Rudolf Milla, Hofstattgasse 2, both of D-88131, Lindau (DE)

( * ) Notice: Subject to any disclaimer, the term of this patent is extended or adjusted under 35 U.S.C. 154(b) by 0 days.

(21) Appl. No.: 09/445,287

(22) PCT Filed: Jun. 2, 1998

(86) PCT No.: PCT/EP98/03274

§ 371 (c)(1),
(2), (4) Date: Feb. 24, 2000

(87) PCT Pub. No.: WO98/55990

PCT Pub. Date: Dec. 10, 1998

(30) Foreign Application Priority Data

Jun. 6, 1997 (DE) ..... 197 23 697

(51) Int. Cl.[7] ..... G10D 13/02
(52) U.S. Cl. ..... 84/422.1; 84/422.2; 84/422.3
(58) Field of Search ..... 84/422.1, 422.2, 84/422.3

(56) References Cited

U.S. PATENT DOCUMENTS

| | | | | |
|---|---|---|---|---|
| 1,369,233 A | | 2/1921 | Fitzgerald et al. | |
| 3,677,128 A | * | 7/1972 | Simpson | 84/422 |
| 3,988,957 A | | 11/1976 | Escamilla | 84/422 R |
| 5,204,485 A | * | 4/1993 | Lombadi | 84/422.1 |
| 5,421,325 A | * | 6/1995 | Lombardi | 84/422.1 |
| 5,591,929 A | * | 1/1997 | Wellman | 84/422.1 |
| 5,756,911 A | * | 5/1998 | Paterson | 84/220 |
| 5,994,635 A | * | 11/1999 | Hoshino | 84/422.1 |
| 6,028,259 A | * | 2/2000 | Lombardi et al. | 84/422.1 |
| 6,188,007 B1 | * | 2/2001 | Liano | 84/422.3 |

FOREIGN PATENT DOCUMENTS

| | | |
|---|---|---|
| DE | 33 27 687 C2 | 2/1985 |
| FR | 2 598 544 | 11/1987 |
| GB | 2 146 162 A | 4/1985 |
| GB | 2 172 137 A | 9/1986 |

* cited by examiner

*Primary Examiner*—Robert E. Nappi
*Assistant Examiner*—Kim Lockett
(74) *Attorney, Agent, or Firm*—Baker & Daniels

(57) ABSTRACT

The invention relates to a pedal device for a bass drum mounted with a mobile pedal (2, 3) which is connected to a mallet (15, 16) which beats against the bass drum via an operating mechanism (8–10, 12, 13). The pedal (2, 3) is configured in two mobile parts which are independent of each other. They each act on a mallet (15, 16) via an associated operating mechanism (8–10, 12, 13).

17 Claims, 1 Drawing Sheet

PEDAL DEVICE FOR A BASS DRUM

Figure 1:
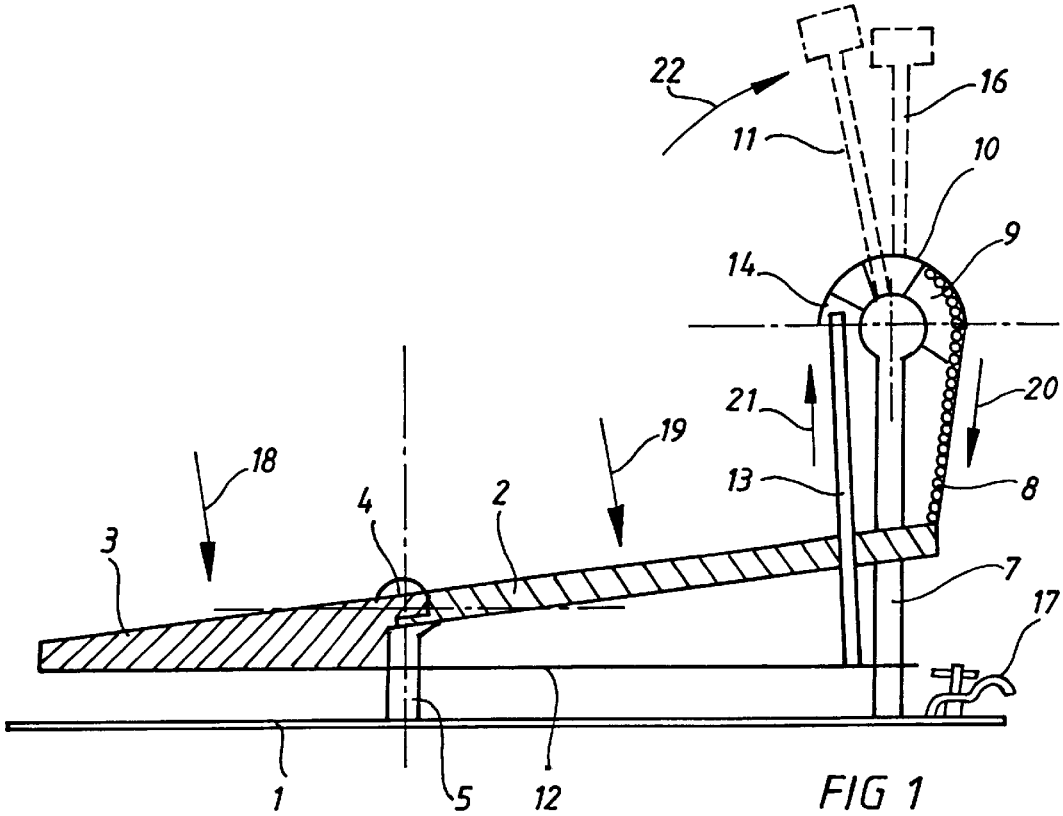

The invention relates to a pedal device for a bass drum according to the characterizing clause of patent claim 1.

Pedal devices for bass drums are available in many different types and variations. "Sticks", the professional magazine for drums and percussion instruments, published a market overview of the available bass drum pedals in May 1997, pages 62 and 63.

The goal of the developments is to transfer the drummer's foot play to the bass drum quickly and precisely. The pedal devices comprise a base plate or a frame structure which is attached to the edge of the bass drum by means of a clamping claw. A slanted pedal is arranged rotating about a horizontal axis in the basic frame of the pedal device. It is pre-stressed in a neutral position by means of a spring or similar device. The pedal acts on an operating mechanism, typically a chain mechanism, which transfers the pedal's rocking motion generated by the drummer's foot pressure to a mallet, which in turn activates the bass drum.

In order to play faster or more complicated rhythms many drummers use two pedal devices which are mounted on one or on separate bass drums and which are activated alternating with one foot or simultaneously with both feet.

The drawback of the two pedal option is that the play is imprecise and/or no foot is available for playing the hi-hats (foot activated drum).

The object of the invention is to further develop a pedal device for a bass drum so as to allow playing variations using only one foot which variations could previously not be played or could be played only when using two pedal devices.

The problem is solved by the characterizing features of patent claim 1.

The pedal device of the invention comprises a base plate and a basic structure which is arranged on the base plate on which a two-part pedal is arranged. Both pedal parts are arranged independent from each other swivelling about a common or individual horizontal axis.

Each of the two pedal parts acts on an associated operating mechanism that transfers the rocking motion of each pedal part, which is generated by foot activation, to a mallet associated to each pedal.

The operating mechanisms are configured as a chain mechanism and/or a lever or crank mechanism.

The pedal parts are preferably arranged so that one, the front pedal part, is played with the tip of the foot while the other, the rear pedal part, is played with the heel of the foot. Accordingly, the pedal device can be played according to the conventional method and additionally using the heel.

The advantages resulting from the above are obvious.

In order to play a basic rhythm the drummer now simply has to perform a rocking motion with his foot. The strokes on the bass drum amount to twice the frequency of the rocking motion. This permits that a fast basic rhythm is played while moving the foot relatively slowly.

Varying the foot play, i.e. rhythmically alternating the play between tip and heel of the foot, allows basic rhythms, combinations and variations of sound using only one foot which previously could not be played at all or were achieved only with two pedal devices because either the "speed of play" allowed by the pedal device reached its limits or else the drummers "ability" was inadequate.

Figure 2:
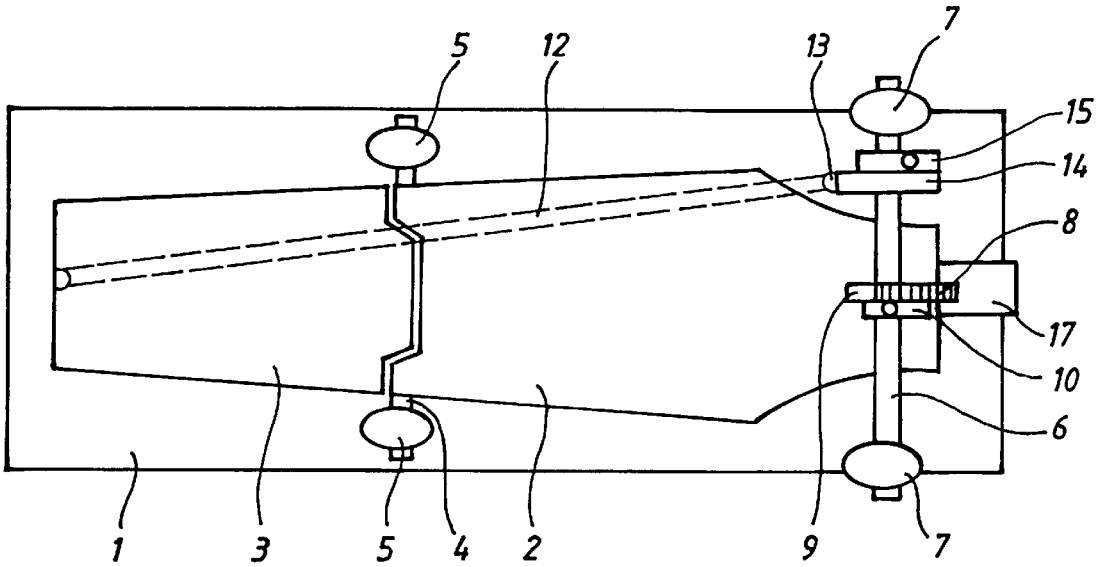

Additional details and characteristic features of the invention are found in the following description of a particular exemplary embodiment by means of several drawings, as follows:

FIG. 1: schematic representation of the pedal device of the invention in lateral profile;

FIG. 2: top view of the representation as per FIG. 1.

The drawings are merely schematic representations of a potential embodiment of the invention. For a better overview, the mallets are not shown in FIG. 2.

The pedal device comprises a base plate 1 on which two bearing supports 5 are mounted that extend approximately vertically upward. The bearing supports 5 carry a horizontal pedal bearing 4 on which a two-part pedal is mounted swivelling comprising a front pedal part 2 and a rear pedal part 3. The front pedal part 2 is mounted to the pedal bearing 4 via its rear end, the rear pedal part 3 via its front end.

The respective free ends of the pedal parts 2, 3 are not in contact with the base plate 1 and are not supported by said plate.

In the front area of the base plate 1 two additional bearing supports 7 are arranged carrying a horizontal mounting axle 6.

The operating mechanism coupling pedal part 2 and mallet 11 comprises a chain mechanism as described hereinafter. On the mounting axle 6 a gear ring 9 is mounted rotating by means of a conventional method. Said gear ring is connected with the free front end of the front pedal part 2 via a chain 8. A seat 10 for the mallet is connected non-rotating with the gear ring 9. The mallet 11 is mounted on said seat.

A connecting rod bearing 14 is provided rotating on the mounting axle 6 spaced apart from the gear ring 9. A second mallet seat 15 is connected non-rotating with said connecting rod bearing for mounting a second mallet 16.

The operating mechanism coupling pedal part 3 and mallet 16 is a crank mechanism comprising actuating rod 12 is mounted to the rear pedal part 3 extending approximately horizontally forward. It is connected flexibly with a connecting rod 13 that extends vertically upward and is mounted flexibly to the connecting rod bearing 14.

Functional method:

When the front pedal part 2 is activated downward in the direction of the arrow 19 the chain 8 acts on the gear ring 9 with a tensile force in the direction of the arrow 20. The gear ring 9 translates the tensile force into a rotating movement and moves the mallet seat 10 with the mallet 11 forward in the direction of the arrow 22.

When the rear pedal part 3 is activated in the direction of the arrow 18, it moves downward causing the free end of the actuating rod to move upward, transferring this motion to the connecting rod 13 and pushing said rod upward in the direction of the arrow 21.

The connecting rod bearing 14 translates the connecting rod's 13 linear movement into a rotating motion, thereby moving the mallet seat 15 with the mallet 16 in the direction of the arrow 22.

Accordingly, by activating the pedal parts 2 or 3, respectively, the associated mallet 11, 16 can be moved in the direction 22.

A tensile or pressure spring interacts with the gear ring 9 or the connecting rod bearing 14, respectively, by a commonly known method. Said spring returns the mechanism or the respective pedal to its original position after actuation. For a better overview, the above springs are not included in the drawings.

DRAWING REFERENCE

1 base plate
2 pedal part (front)
3 pedal part (rear)

4 pedal bearing
5 bearing support
6 mounting axle
7 bearing support
8 chain
9 gear ring
10 mallet seat
11 mallet
12 actuating rod
13 connecting rod
14 connecting rod bearing
15 mallet seat
16 mallet
17 clamping claw
18 direction of arrow
19 direction of arrow
20 direction of arrow
21 direction of arrow
22 direction of arrow

What is claimed is:

1. Pedal device for bass drum with a movable pedal which is connected with a mallet by means of operating mechanisms for activating the bass drum, where the pedal has two parts oriented front-to-back with respect to the foot of the user, where both pedal parts are mounted movable independent from each other and each acting on a mallet via an associated operating mechanism, where one end of each of the pedal parts is mounted swivelling on a common pedal bearing, and wherein the two pedal parts are substantially in a common plane in neutral position.

2. Pedal device according to claim 1, characterized in that the operating mechanism associated with one of said pedal parts is a chain mechanism.

3. Pedal device according to claim 2, characterized in that the chain mechanism comprises a chain mounted on the free end of said one pedal part, which chain acts on a gear ring to which the respective mallet is attached.

4. Pedal device according to claim 3, characterized in that the operating mechanism associated with the other of said pedal parts is a crank mechanism.

5. Pedal device according to claim 4, characterized in that the crank mechanism comprises an actuating rod which is connected to said other pedal part and extends forward, which actuating rod is connected flexibly with a connecting rod which, in turn, is flexibly connected with a connecting rod bearing to which the respective mallet is attached.

6. Pedal device according to claim 5, characterized in that said one pedal part is arranged such that it can be activated with the tip of the foot while said other pedal part is arranged such that it can be activated with the heel of the foot.

7. Pedal device according to claim 2, characterized in that the chain mechanism comprises a chain mounted on the free end of said one pedal part, which chain acts on a gear ring to which the respective mallet is attached.

8. Pedal device according to claim 1, characterized in that the operating mechanism associated with one of said pedal parts is a crank mechanism.

9. Pedal device according to claim 2, characterized in that the operating mechanism associated with the other pedal part is a crank mechanism.

10. Pedal device according to claim 8, characterized in that the crank mechanism comprises an actuating rod which is connected to said one pedal part and extends forward, which actuating rod is connected flexibly with a connecting rod which, in turn, is flexibly connected with a connecting rod bearing on which the mallet is attached.

11. Pedal device according to claim 2, characterized in that the crank mechanism comprises an actuating rod which is connected to the other pedal part and extends forward, which actuating rod is connected flexibly with a connecting rod which, in turn, is flexibly connected with a connecting rod bearing to which the mallet is attached.

12. Pedal device according to claim 3, characterized in that the crank mechanism comprises an actuating rod which is connected to the other pedal part and extends forward, which actuating rod is connected flexibly with a connecting rod which, in turn, is flexibly connected with a connecting rod bearing to which the mallet is attached.

13. Pedal device according to claim 1, characterized in that one pedal part is arranged such that it can be activated with the tip of the foot while the other pedal part is arranged such that it can be activated with the heel of the foot.

14. Pedal device according to claim 2, characterized in that said one pedal part is arranged such that it can be activated with the tip of the foot while the other pedal part is arranged such that it can be activated with the heel of the foot.

15. Pedal device according to claim 3, characterized in that said one pedal part is arranged such that it can be activated with the tip of the foot while the other pedal part is arranged such that it can be activated with the heel of the foot.

16. Pedal device according to claim 4, characterized in that said one pedal part is arranged such that it can be activated with the tip of the foot while the other pedal part is arranged such that it can be activated with the heel of the foot.

17. The pedal device according to claim 1, characterized in that each of the pedal parts rotate about a common axis of rotation on the common pedal bearing.

* * * * *